US007443346B2

(12) United States Patent
Shih

(10) Patent No.: US 7,443,346 B2
(45) Date of Patent: Oct. 28, 2008

(54) PRINTED ANTENNA

(75) Inventor: Yen-Yi Shih, Taipei Hsien (TW)

(73) Assignee: Hon Hai Precsion Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/614,999

(22) Filed: Dec. 22, 2006

(65) Prior Publication Data

US 2007/0279292 A1 Dec. 6, 2007

(30) Foreign Application Priority Data

Jun. 2, 2006 (CN) ..... 95 1 19611

(51) Int. Cl.
*H01Q 1/38* (2006.01)
*H01Q 13/10* (2006.01)

(52) U.S. Cl. ..... 343/700 MS; 343/767; 343/770

(58) Field of Classification Search ..... 343/700 MS, 343/767, 770
See application file for complete search history.

(56) References Cited

U.S. PATENT DOCUMENTS 6,353,443 B1 3/2002 Ying
7,061,442 B1 * 6/2006 Tang et al. ..... 343/767
2006/0103577 A1 * 5/2006 Lee ..... 343/700 MS

* cited by examiner

*Primary Examiner*—Robert Karacsony
(74) *Attorney, Agent, or Firm*—Wei Te Chung

(57) ABSTRACT

A printed antenna disposed on a substrate, includes a radiation part, a feed line, and at least one first ground part. The radiation part is for radiating and receiving electromagnetic signals, and includes a hollow portion and a pair of openings. The hollow portion is defined in the radiation part, and comprises a first slot connected to a second slot, which is connected to a third slot, wherein the second slot extends between the first slot and the third slot forming a substantially h-shaped pattern. The openings are formed at two edges of the radiation part. The feed line for feeding the electromagnetic signals to the radiation part is electrically connected to the radiation part. The at least one first ground part for grounding is disposed at one side of the feed line.

15 Claims, 6 Drawing Sheets

PRINTED ANTENNA

BACKGROUND OF THE INVENTION

1. Field of the Invention

The present invention relates to printed antennas disposed on substrates, and particularly to a printed antenna with a hollow portion, the printed antenna being disposed on a substrate in a wireless local area network (WLAN) or 802.16 compatible device.

2. Description of Related Art

Communication standards have been developed to control wireless communications over widely-spaced frequency bands. An example is the 802.16 standard of the Institute of Electrical and Electronics Engineers (IEEE) that concerns wireless communication in wireless area networks. Commonly referred to as WiMAX (Worldwide Interoperability For Microwave Access), this standard is intended to facilitate wireless networks of wide communication services. Presently, under the IEEE 802.16 standard, WiMAX communication devices are restricted to intentional operation between 2.3 and 3.6 GHz.

In recent years, more attention has been paid on developments of small-sized wireless communication devices, such as mobile phones, wireless cards, and access points, for convenient portability. An antenna, as one of the key elements of the wireless communication devices, has to be miniaturized accordingly. Biconical antennas are often used as WiMAX antennas to achieve the widely-spaced frequency bands, but the profile of the conventional WiMAX antennas is still large. Therefore, what is needed is a smaller more compact WiMAX antenna.

SUMMARY OF THE INVENTION

In one aspect of the invention, a printed antenna disposed on a substrate, includes a radiation part, a feed line, and at least one first ground part. The radiation part is for radiating and receiving electromagnetic signals, and includes a hollow portion and a pair of openings. The hollow portion is defined in the radiation part. The openings are formed at two edges of the radiation part. The feed line for feeding the electromagnetic signals to the radiation part is electrically connected to the radiation part. The at least one first ground part for grounding is disposed at one side of the feed line.

In another aspect of the invention, a printed antenna disposed on a substrate, includes an annularly radiation part, a feed line, at least one first ground part, and a second ground part. The radiation part is for radiating and receiving electromagnetic signals. The feed line for feeding the electromagnetic signals to the radiation part is electrically connected to the radiation part. The at least one first ground part is disposed on a first surface of the substrate at one side of the feed line. The second ground part is disposed on a second surface of the substrate opposite to the first surface. An extending length of the second ground part is greater than an extending length of the first ground part along the feed line.

Other advantages and novel features will become more apparent from the following detailed description when taken in conjunction with the accompanying drawings, in which:

DETAILED DESCRIPTION OF THE INVENTION

Figure 1:
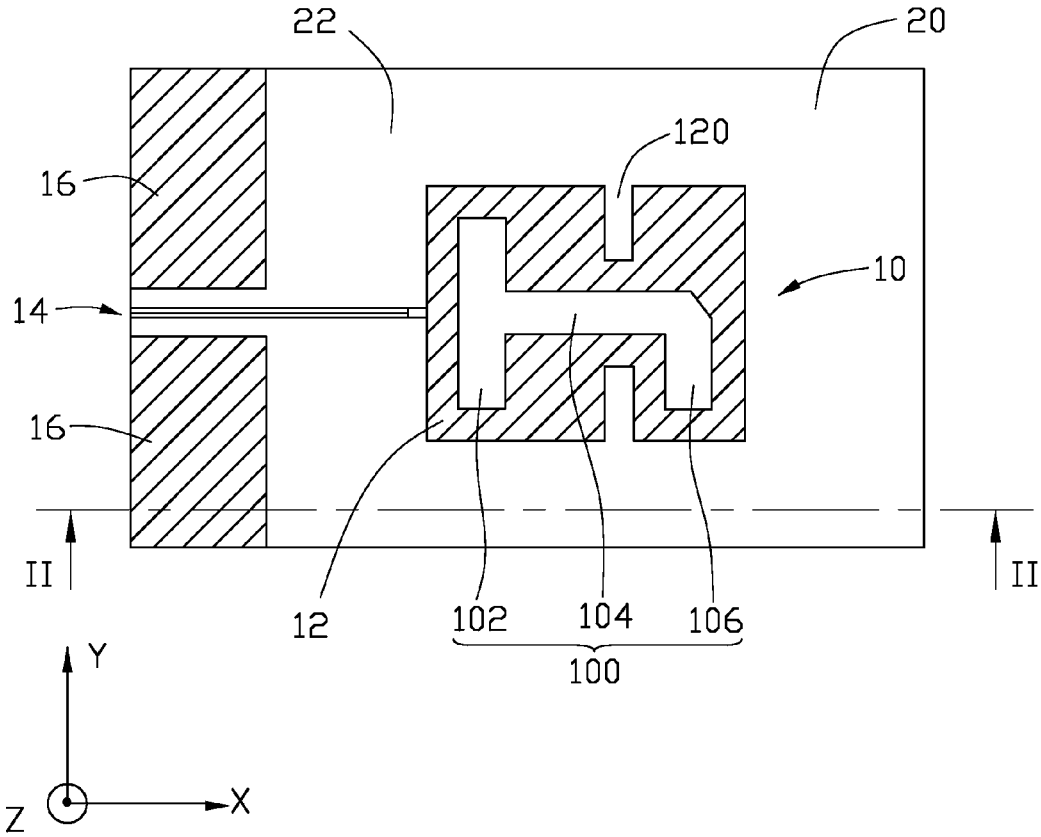
FIG. 1 is a schematic view of a printed antenna of an exemplary embodiment of the present invention.

Referring to FIG 1, a printed antenna 10 of an exemplary embodiment of the present invention is shown. The printed antenna 10, disposed on a substrate 20, includes a radiation part 12, a feed line 14, at least one first ground part 16, and a second ground part 18 (as shown in FIG 2).

Figure 2:
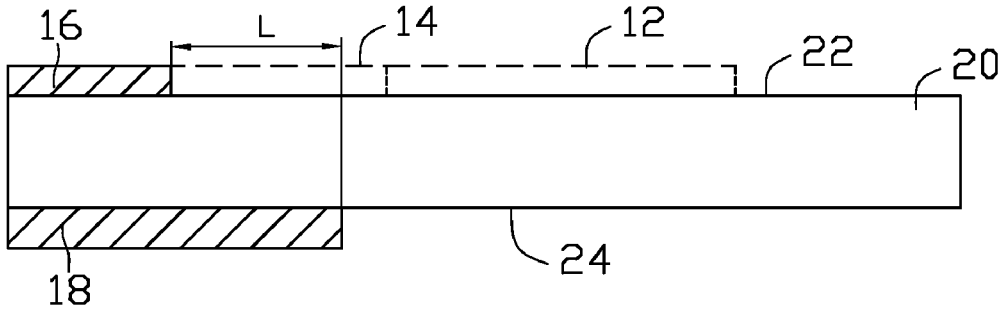
FIG. 2 is a cross-sectional view along line II-II of FIG. 1.

The radiation part 12, the feed line 14, and the first ground part 16 are all disposed on a first surface 22 (as shown in FIG. 2) of the substrate 20. The feed line 14 is substantially electrically connected to a middle of the radiation part 12, for feeding electromagnetic signals to the radiation part 12. The at least one first ground part 16 is disposed at one side of the feed line 14 for grounding. In FIG. 1 of the exemplary embodiment, a pair of first ground parts 16 is symmetrically disposed at two sides of the feed line 14 for grounding.

The radiation part 12 is substantially rectangular, for radiating and receiving the electromagnetic signals. In other exemplary embodiments, the radiation part 12 can be circular, polygonal, or other shapes. The radiation part 12 comprises a hollow portion 100 and a pair of openings 120 defined on an edge thereof.

The hollow portion 100 is defined in the radiation part 12, and includes a first slot 102 communication with a second slot 104, which in turn communicates with a third slot 106. The second slot 104 is perpendicular to the first slot 102 and parallel to the feed line 14, and extends from a substantially middle portion of the first slot 102. The third slot 106 is parallel to the first slot 102, and extends from one end of the second slot 104. The second slot 104 extends between the first slot 102 and the third slot 106 to form a substantially h-shaped slot. The width of the radiation part 12 varies according to arrangement of the hollow portion 100. For example, the width of the radiation part 12 is smaller around the first and third slots 102, 106, and the width of the radiation part 12 is larger around the second slot 104.

In other exemplary embodiments, the second slot 104 may not extend parallel to the feed line 14 and/or perpendicular to the first slot 102, and the third slot 106 may not be parallel to the first slot 102.

In the exemplary embodiment, the openings 120 extend perpendicularly to the feed line 14, and are symmetrically defined on two opposite edges of the radiation part 12, respectively. In other exemplary embodiments, the openings 120 can be asymmetrically defined at two edges of the radiation part 12.

FIG 2 is a cross-sectional view along line II-II of FIG 1. In the exemplary embodiment, the second ground part 18 is disposed on a second surface 24 of the substrate 20 opposite to the first surface 22. An extending length of the second ground part 18 is L mm greater than that of the first ground part 16 along the feed line 14, for enhancing mapping effects generated between the second grounding part 18 and the radiation part 12. The enhanced mapping effects broaden an operating frequency of the printed antenna 10 by providing a more complete ground plane for image-effect radiation.

In the exemplary embodiment, a length and a width of the feed line 14 are respectively about 20 millimeters (mm) and 0.53 mm. A length and a width of the radiation part 12 are respectively about 21.7 mm and 17.53 mm. A length and a width of the first slot 102 are respectively about 13.13 mm and 3.2 mm. A Length and a width of the second slot 104 are respectively about 10.9 mm and 3.2 mm. A length and a width of the third slot 106 are respectively about 8.3 mm and 3.2 mm. A length and a width of the openings 120 are respectively about 5.1 mm and 2 mm. The length L is about 10 mm. In other exemplary embodiments, the above lengths and widths of elements of the printed antenna 10 can be changed.

Figure 3:
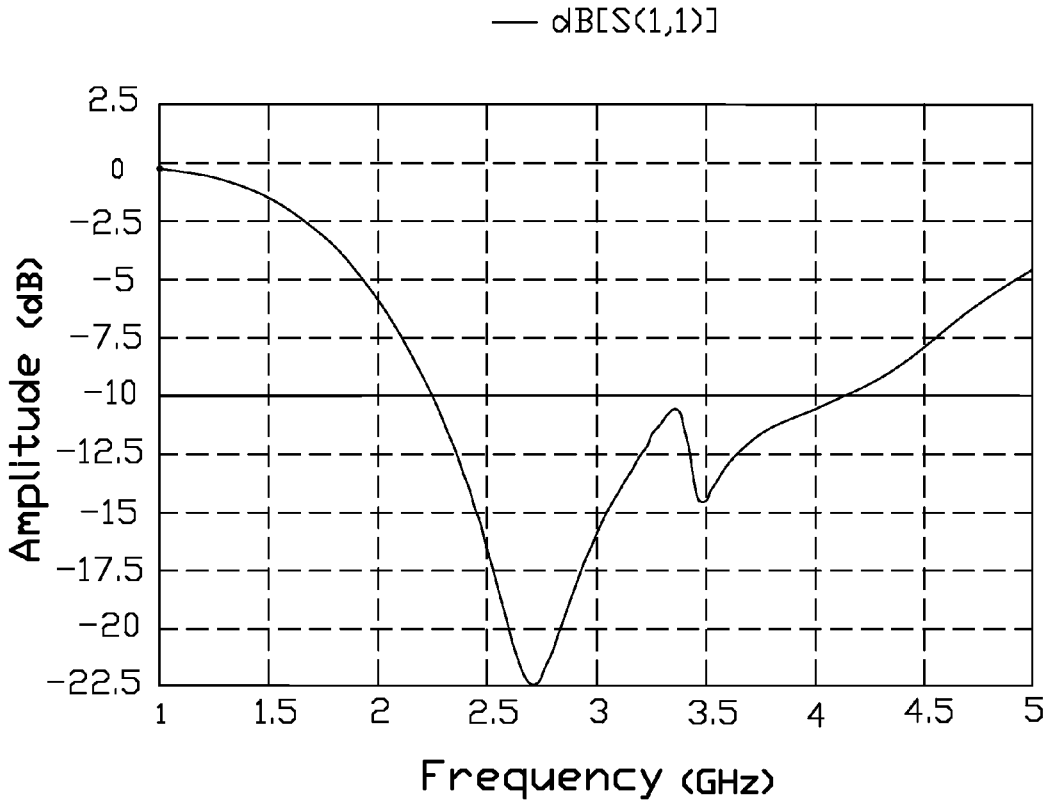
FIG. 3 is a graph of test results showing a reflection scatter parameter of the printed antenna of FIG 1.

FIG. FIG 3 is a graph of test results showing a reflection scatter parameter of the printed antenna 10. As shown, when the printed antenna 10 operates at working frequency bands of 2.3~3.6 GHz, its reflection scatter parameter is less than −10 dB, which is within operating standards as set forth in IEEE 802.16.

Figure 4:
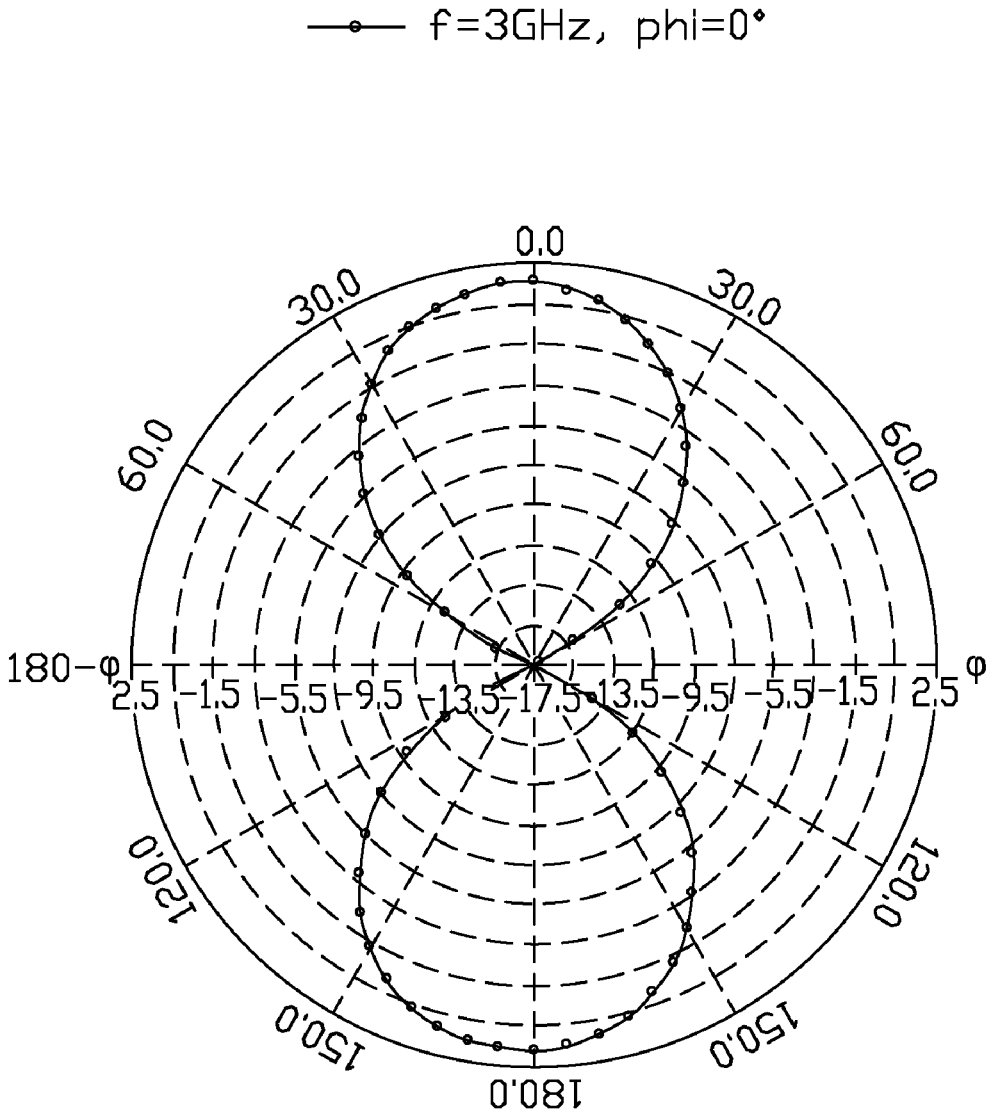
FIGS. 4-5 are graphs of test results showing radiation patterns when the printed antenna of FIG. 1 is operated at 3GHz.
Figure 5:
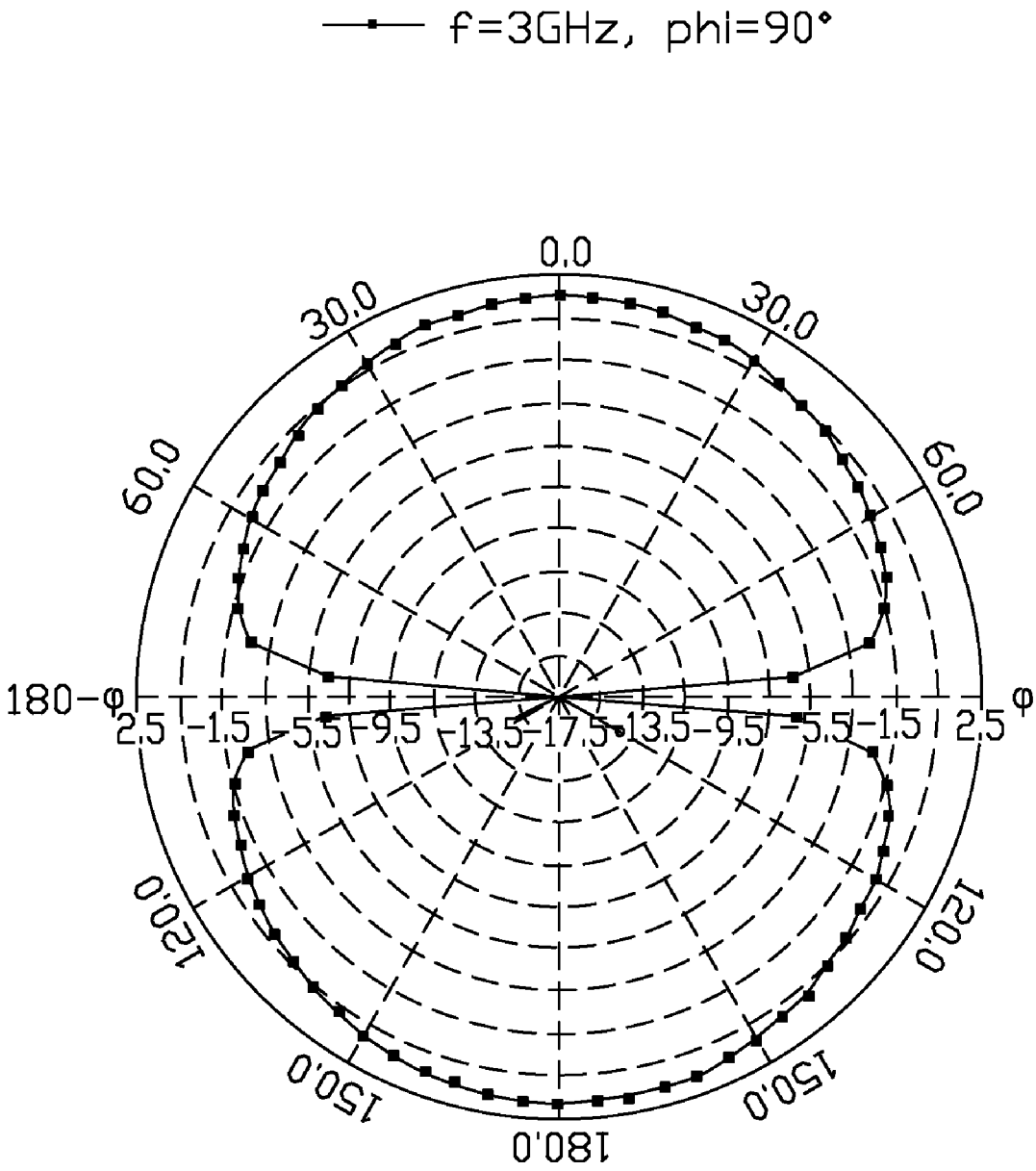

FIGS. 4-5 are graphs of test results showing radiation patterns in horizontal and vertical planes when the printed antenna 10 is operated at 3 GHz. It is to be noted that each radiation pattern is close to an optimal radiation pattern at the Y-Z plane except for +Y and −Y directions when the printed antenna 10 is operated at 3 GHz.

Figure 6:
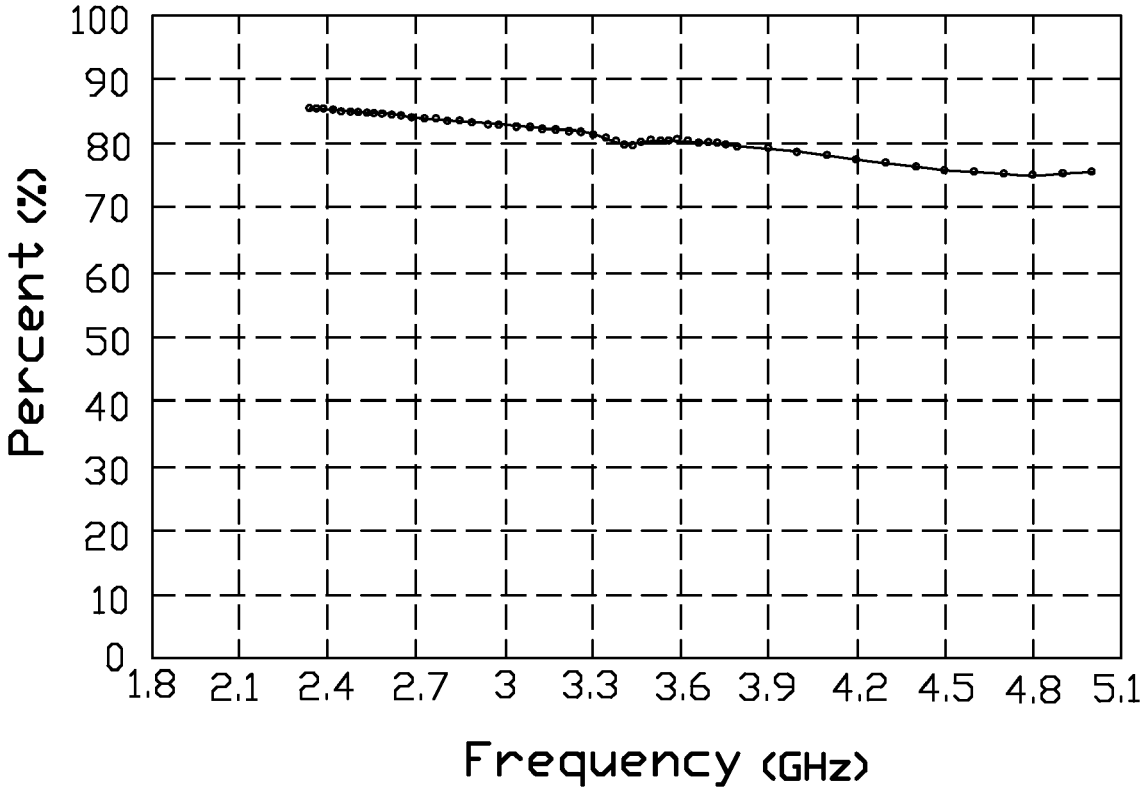
FIG. 6 is a graph of test results showing radiation efficiency performance of printed antenna of FIG. 1.

FIG 6 is a graph of test results showing radiation efficiency performance of the printed antenna 10. As shown, when the printed antenna 10 operates at working frequency bands of 2,3~3.6 GHz, the radiation efficiency is more than 75%. Therefore the printed antenna 10 has good performance.

While exemplary embodiments have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. A printed antenna, disposed on a substrate, comprising:

a radiation part, for radiating and receiving electromagnetic signals, comprising a hollow portion defined therein, and a pair of openings formed at two edges of the radiation part, wherein the hollow portion defines a first slot connected to a second slot, which is connected to a third slot, and the second slot extends between the first slot and the third slot forming a substantially h-shaped pattern;

a feed line electrically connected to the radiation part, for feeding the electromagnetic signals to the radiation part; and at least one first ground part disposed at one side of the feed line, for grounding.

2. The printed antenna of claim 1 wherein the radiation pan is substantially annular.

3. The printed antenna of claim 1, wherein the openings extend perpendicular to the feed line from the opposite edges of the radiation part.

4. The printed antenna of claim 1, wherein the second slot extends from a middle of the first slot and the third slot extends from one end of the second slot.

5. The printed antenna of claim 1, wherein the radiation part and the feed line are both disposed on a first surface of the substrate.

6. The printed antenna of claim 5, wherein the first ground part is disposed on the first surface of the substrate.

7. The printed antenna of claim 6, further comprising a second ground part disposed on a second surface of the substrate opposite to the first surface.

8. The printed antenna of claim 7, wherein an extending length of the second ground part is greater than an extending length of the first ground part along the feed line.

9. A primed antenna, disposed on a substrate, comprising:

an annularly shaped radiation part, for radiating and receiving electromagnetic signals, and comprising a hollow portion therein which defines a first slot, a second slot, and a third slot, the second slot extending between the first slot and the end of the third slot to form a substantially h-shaped slot;

a feed line electrically connected to the radiation part, for feeding the electromagnetic signals to the radiation part;

at least one first ground part disposed on a first surface of the substrate, and disposed at one side of the feed line; and a second ground part disposed on a second surface of the substrate opposite to the first surface, an extending length of the second ground part being greater than an extending length of the first ground part along the feed line.

10. The printed antenna of claim 9, wherein the second slot extends from a middle of the first slot, and the third slot extends from one end of the second slot.

11. The printed antenna of claim 9, further comprising a pair of openings formed at two edges of the radiation part.

12. The printed antenna of claim 11, wherein the openings extend perpendicular to the feed line from opposite edges of the radiation part.

13. An antenna assembly comprising:

a substrate; and an antenna disposed on said substrate, comprising a radiation part for radiating and receiving electromagnetic signals, and a feed line electrically connectable with said radiation part for feeding said electromagnetic signals to said radiation part, said radiation part comprising a hollow portion formed at a middle of said radiation part and entirely surrounded by said radiation part, a width of said radiation part beside said hollow portion varying according to spatial arrangement of said hollow portion, wherein said hollow portion defines at least two independently identifiable slots, and one of said at least two slots is arranged perpendicular to another of said at least two slots to co-form a substantially h-shaped pattern for said hollow portion.

14. The antenna assembly of claim 13, wherein said width of said radiation part beside said one of said at least two slots is smaller than said width of said radiation part beside said another of said at least two slots.

15. The antenna assembly of claim 13, further comprising a pair of openings formed at two edges of said radiation part and extending along a same straight line to approach each other.

* * * * *